US007766724B2

(12) United States Patent
Huber et al.

(10) Patent No.: US 7,766,724 B2
(45) Date of Patent: Aug. 3, 2010

(54) METHOD FOR SIMULTANEOUSLY SLICING AT LEAST TWO CYLINDRICAL WORKPIECES INTO A MULTIPLICITY OF WAFERS

(75) Inventors: Anton Huber, Burghausen (DE); Alexander Heilmaier, Haiming (DE); Clemens Radspieler, Prienbach/Inn (DE); Helmut Seehofer, Burghausen (DE)

(73) Assignee: Siltronic AG, Munich (DE)

( * ) Notice: Subject to any disclaimer, the term of this patent is extended or adjusted under 35 U.S.C. 154(b) by 254 days.

(21) Appl. No.: 11/923,722

(22) Filed: Oct. 25, 2007

(65) Prior Publication Data

US 2008/0099006 A1 May 1, 2008

(30) Foreign Application Priority Data

Oct. 25, 2006 (DE) ..... 10 2006 050 330

(51) Int. Cl.
*B24B 49/00* (2006.01)
*B24D 1/06* (2006.01)

(52) U.S. Cl. ..... 451/5; 125/16.02; 125/21

(58) Field of Classification Search ..... 451/5, 451/8; 125/16.01, 16.02, 21
See application file for complete search history.

(56) References Cited

U.S. PATENT DOCUMENTS 5,715,806 A * 2/1998 Tonegawa et al. ..... 125/16.02
5,937,844 A * 8/1999 Kiuchi et al. ..... 125/16.02

(Continued)

FOREIGN PATENT DOCUMENTS

DE 10210021 A1 8/2002

OTHER PUBLICATIONS

English Derwent Abstract AN 2002-610015 corresponding to DE 102 10 021 A1.

*Primary Examiner*—Eileen P. Morgan
(74) *Attorney, Agent, or Firm*—Brooks Kushman PC

(57) ABSTRACT

Slicing multiple cylindrical workpieces into wafers by a multi wire saw with a gang length $L_G$, is performed by:

a) selecting a number n≧2 of workpieces from a stock of workpieces with different lengths, satisfying the inequality $$L_G \geq (n-1)\cdot A_{\min} + \sum_{i=1}^{n} L_i \quad (1)$$

and making right-hand side of the inequality as large as possible, where $L_i$ with i=1 . . . n are for the lengths of the workpieces and $A_{min}$ is a predefined minimum spacing, b) fixing the n workpieces successively in the longitudinal direction on a mounting plate while maintaining a spacing $A \geqq A_{min}$ therebetween such that the relationship $$L_G \geq (n-1)\cdot A + \sum_{i=1}^{n} L_i \quad (2)$$

is satisfied, c) clamping mounting plates workpieces in a multi wire saw, and d) slicing the n workpieces perpendicularly to their longitudinal axis by means of the multi wire saw. Preferably, the wafer stacks are separated from one another by separating pieces after slicing, and at the same time are laterally supported.

15 Claims, 3 Drawing Sheets

U.S. PATENT DOCUMENTS 6,062,209 A * 5/2000 Oishi ..... 125/16.01
6,119,673 A * 9/2000 Nakaura ..... 125/12
6,802,928 B2 10/2004 Nakashima
7,025,665 B2 * 4/2006 Bender ..... 451/296
7,114,424 B2 * 10/2006 Muller et al. ..... 83/459
2004/0084042 A1 * 5/2004 McAulay et al. ..... 125/21

* cited by examiner

METHOD FOR SIMULTANEOUSLY SLICING AT LEAST TWO CYLINDRICAL WORKPIECES INTO A MULTIPLICITY OF WAFERS

BACKGROUND OF THE INVENTION

1. Field of the Invention

The invention relates to a method for simultaneously slicing at least two cylindrical workpieces into a multiplicity of wafers by means of a multi wire saw.

2. Background Art

Multi wire saws are used for example for slicing cylindrical mono- or polycrystalline workpieces of semiconductor material, for example silicon, simultaneously into a multiplicity of wafers in one working step. The production of semiconductor wafers from cylindrical semiconductor material, for example single crystal rods, places exacting requirements on the sawing method. The sawing method ideally ensures that each sawed semiconductor wafer should have two surfaces which are as plane as possible and lie parallel to one another. The throughput of the multi wire saw is also of great importance for economic viability.

In order to increase the throughput, it has been proposed for a plurality of workpieces to be simultaneously clamped into the multi wire saw and sliced in one working step. U.S. Pat. No. 6,119,673 describes the simultaneous slicing of a plurality of cylindrical workpieces, which are arranged coaxially behind one another. To this end a conventional multi wire saw is used, a plurality of workpieces each adhesively bonded on a sawing bar being fixed with a certain spacing in a coaxial arrangement on a common mounting plate, clamped with it into the multi wire saw and sliced simultaneously. This creates a number of stacks of wafers, which are still fixed on the mounting plate, corresponding to the number of workpieces. After the slicing, separating plates are placed loosely into the spaces between the stacks of wafers, in order to prevent the wafers of the various stacks from being confused. This is of great importance since the wafers produced from different workpieces will generally be further processed in different ways and/or the workpieces may have different properties, specified by the customer to which the wafers will be delivered. It is therefore necessary to ensure that all wafers produced from a workpiece intended for a certain customer or a certain order are further processed together, but processed separately from wafers produced from other workpieces.

After the various wafer stacks have been demarcated by separating plates, the mounting plate is immersed in a basin of hot water so that the wafers connected to the mounting plate via the sawing bar hang below the mounting plate. The hot water dissolves the cement bond between the wafers and the sawing bars, so that the detached wafers fall into a wafer carrier placed at the bottom of the basin. The various wafer stacks, which are subsequently contained in the wafer carrier, are separated from one another by the previously introduced separating plates.

The method disclosed in U.S. Pat. No. 6,119,673 for demarcating the various stacks of wafers has the disadvantage that the wafer stacks are not secured against lateral tilting (as can be seen in FIG. 8(C) of U.S. Pat. No. 6,119,673) and the edges, which are very sharp after the slicing, consequently fracture. Placement of the separating disks according to the method described in this application is furthermore very difficult, since the separating disks must be inserted between the labile separated wafer stacks and held in their position while the wafer stack is lowered into the wafer carrier from above. If a separating plate comes in contact with a wafer stack during this process, then wafers may break off from the sawing bar, fall into the wafer carrier from a relatively large height and therefore be damaged or destroyed.

U.S. Pat. No. 6,802,928 B2 describes a method in which dummy pieces with the same cross section are adhesively bonded onto the end surfaces of the workpiece to be sliced, sliced with the workpiece and then discarded. This is intended to prevent the resulting wafers from fanning out at the two ends of the workpiece during the end phase of the slicing, and therefore to improve the wafer geometry. This method has the crucial disadvantage that some of the gang length, which is limited by the dimensions of the multi wire saw, is used for slicing the "unused" dummy pieces and is therefore not available for the actual production of the desired wafers. Furthermore, the provision, handling and adhesive bonding of dummy pieces is very elaborate. Both lead to a significant reduction in economic viability.

Also in the method described in U.S. Pat. No. 6,119,673 for simultaneously slicing a plurality of workpieces in a multi wire saw, the gang length of the multi wire saw often cannot be utilized optimally since the workpieces to be sliced have very different lengths owing to the way in which they are produced. This problem arises particularly when the workpieces consist of monocrystalline semiconductor material, since the known crystal pulling processes only permit certain usable lengths of the crystals or it is necessary to cut the crystals and produce test specimens at various positions of the crystal in order to control the crystal pulling process. Furthermore, various types of semiconductor wafers with different properties (which for the most part are already defined by the crystal from which the wafers are produced) are usually fabricated in the same plant for a plurality of customers, in which case different delivery deadlines need to be complied with.

SUMMARY OF THE INVENTION

It was therefore an object of the invention to improve the utilization of the available gang length of a multi wire saw. It was also an object to avoid damaging the wafers during the insertion of separating plates or the wafer edges during separation from the mounting plate and individualization. These and other objects are achieved by a sawing process in which a plurality of workpieces are sawed simultaneously, the lengths of the individual workpieces selected such that maximum utilization of gang length occurs. The wafers from each workpiece are preferably separated from those of other workpieces and edge damage is also prevented by spacer elements fastened to the wafer carrier.

DETAILED DESCRIPTION OF THE PREFERRED EMBODIMENT(S)

Figure 1:
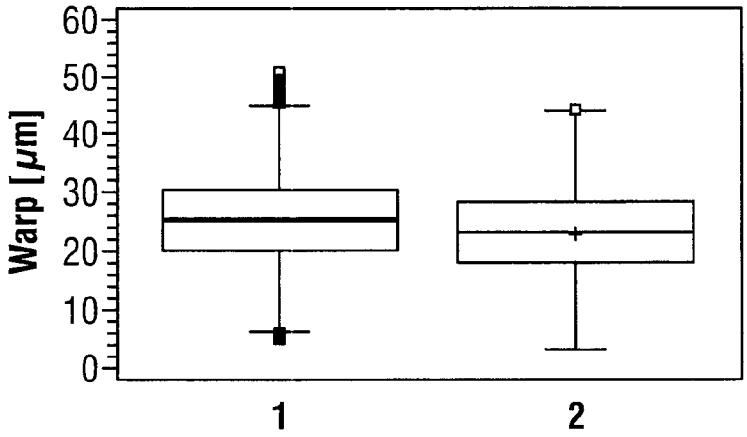
FIG. 1 depicts a statistical evaluation of the geometrical parameter "warp" for wafers produced from workpieces of different length.

The invention relates to a first method for simultaneously slicing at least two cylindrical workpieces into a multiplicity of wafers by means of a multi wire saw with a gang length $L_G$, comprising the following steps:

a) selecting a number n≧2 of workpieces from a stock of workpieces with different lengths, so that the inequality $$L_G \geq (n-1)\cdot A_{\min} + \sum_{i=1}^{n} L_i \tag{1}$$

is satisfied and at the same time the right-hand side of the inequality is as large as possible, where $L_i$ with i=1 . . . n stands for the lengths of the selected workpieces and $A_{min}$ stands for a predefined minimum spacing, b) fixing the n workpieces successively in the longitudinal direction on a mounting plate while respectively maintaining a spacing $A \geqq A_{min}$ between the workpieces, which is selected so that the relation $$L_G \geq (n-1)\cdot A + \sum_{i=1}^{n} Li \tag{2}$$

is satisfied, c) clamping the mounting plate with the workpieces fixed thereon in the multi wire saw, and d) slicing the n workpieces perpendicularly to their longitudinal axis by means of the multi wire saw.

The invention also relates to a further embodiment for simultaneously slicing at least two cylindrical workpieces into a multiplicity of wafers by means of a multi wire saw, comprising the following steps, with reference to the drawing figures but not limited thereby:

a) selecting a number n≧2 of workpieces from a stock of workpieces with different lengths, b) fixing the n workpieces successively in the longitudinal direction on a mounting plate 11 while respectively maintaining a spacing between the workpieces, c) clamping the mounting plate 11 with the workpieces fixed thereon in the multi wire saw, d) slicing the n workpieces perpendicularly to their longitudinal axis by means of the multi wire saw so as to form n stacks 121, 122, 123 of wafers 12 fixed on the mounting plate 11, e) introducing the wafers 12 fixed on the mounting plate 11 into a wafer carrier 13, which supports each wafer 12 on at least two points of the wafer circumference that lie away from the mounting plate 11, f) introducing at least one separating piece 15 into each of the spaces between two neighboring stacks 121, 122, 123 of wafers 12 and fastening the separating piece 15 on the wafer carrier 13, g) releasing the bond between the wafers 12 and the mounting plate 11, i) sequentially removing each individual wafer 12 from the wafer carrier 13.

In this method, the workpieces are selected from a stock of workpieces with different lengths so that the gang length $L_G$ of the multi wire saw is optimally utilized. Since the capacity of the multi wire saw is therefore exploited better, the productivity is significantly increased.

A conventional multi wire saw is employed in the method according to the invention. The essential components of these multi wire saws include a machine frame, a forward feed device and a sawing tool, which consists of a gang comprising parallel wire sections. The workpiece is generally fixed on a mounting plate and clamped with it in the multi wire saw.

In general, the wire gang of the multi wire saw is formed by a multiplicity of parallel wire sections which are clamped between at least two (and optionally three, four or more) wire guide rolls, the wire guide rolls being mounted so that they can rotate and at least one of the wire guide rolls being driven. The wire sections generally belong to a single finite wire, which is guided spirally around the roll system and is unwound from a stock roll onto a receiver roll. The term gang length refers to the length of the wire gang as measured in the direction parallel to the axes of the wire guide rolls and perpendicularly to the wire sections from the first wire section to the last.

During the sawing process, the forward feed device causes an oppositely directed relative movement of the wire sections and the workpiece. As a consequence of this forward feed movement, the wire, to which a sawing suspension is applied, works to form parallel sawing grooves through the workpiece. The sawing suspension, which is also referred to as a "slurry", contains hard material particles, for example of silicon carbide, which are suspended in a liquid. A sawing wire with firmly bound hard material particles may also be used. In this case, a sawing suspension does not need to be applied. It is merely necessary to add a liquid cooling lubricant, which protects the wire and the workpiece against overheating and simultaneously transports workpiece swarf away from the cutting grooves.

The cylindrical workpieces may consist of any material which can be processed by means of a multi wire saw, for example poly- or monocrystalline semiconductor material such as silicon. In the case of monocrystalline silicon, the workpieces are generally produced by sawing an essentially cylindrical single silicon crystal into crystal pieces with a length of from several centimeters to several tens of centimeters. The minimum length of a crystal piece is generally 5 cm. The workpieces, for example the crystal pieces consisting of silicon, generally have very different lengths but the same cross section. The term "cylindrical" is not to be interpreted as meaning that the workpieces must have a circular cross section. Rather, the workpieces may have the shape of any generalized cylinder, although application of the invention to workpieces with a circular cross section is preferred. A generalized cylinder is a body which is bounded by a cylinder surface with a closed directrix curve and by two parallel planes, i.e. the base surfaces of the cylinder.

Step a):

In step a) of the first method according to the invention, a number $n \geqq 2$ of workpieces is selected from an available stock of workpieces preferably with the same cross section. The stock of workpieces comprises a multiplicity of workpieces with different lengths, although this does not preclude the existence of a plurality of workpieces with the same length. The workpieces are selected so that Inequality (1) is satisfied. This means that the sum of the lengths $L_i$ of the selected workpieces i plus an established minimum spacing $A_{min}$ between each pair of workpieces, which is maintained when fixing the workpieces on a mounting plate, does not exceed the gang length $L_G$. The minimum spacing is freely definable, and may even be zero. It is preferably close to zero, since a larger minimum spacing automatically leads to inferior utilization of the gang length of the multi wire saw. Taking this condition into account, the workpieces are selected from the stock such that the right-hand side of Inequality (1) is as large as possible, so that the gang length is utilized as well as possible when slicing the workpieces.

The workpieces are preferably selected so that the inequality $$L_G \geq (n-1)\cdot A + \sum_{i=1}^{n} L_i \geq L_{\min} \tag{3}$$

is satisfied, where $L_{min}$ stands for a predefined minimum length which is less than the gang length $L_G$. According to this embodiment, the length should not be less than this minimum length when selecting the workpieces. The minimum length $L_{min}$ is preferably established in relation to the gang length $L_G$ so that $L_{min} \geqq 0.7 \cdot L_G$, preferably $L_{min} \geqq 0.75 \cdot L_G$ and particularly preferably $L_{min} \geqq 0.8 \cdot L_G$, $L_{min} \geqq 0.85 \cdot L_G$, $L_{min} \geqq 0.9 \cdot L_G$ or $L_{min} \geqq 0.95 \cdot L_G$.

Since very large stocks of workpieces are usually available, it is expedient and therefore preferable to carry out selection of the workpieces by means of a computer, which has access to the lengths of all workpieces in the stock. For example, the computer may be connected to an EDP-supported stock management system in which all stock input and output processes together with the properties (length and type) of the workpieces are recorded, and which therefore knows the current stock status at any time. A program, in which all rules for the selection of the workpieces are implemented, runs on the computer.

Step b):

In step b), the n selected workpieces are fixed successively with respect to their longitudinal direction on a mounting plate while respectively maintaining a spacing $A \geqq A_{min}$ between the workpieces, which is selected so that Inequality (2) is satisfied. The spacing A must thus on the one hand correspond at least to the predefined minimum spacing $A_{min}$ between two workpieces, but on the other hand it should not be selected to be so large that the sum of the lengths $L_i$ of the workpieces plus the spacings A between the workpieces exceeds the gang length $L_G$. The expression "successively with respect to their longitudinal direction" does not necessarily imply a coaxial arrangement of the workpieces, although this is preferable. The workpieces may nevertheless be arranged so that their longitudinal axes do not lie on the same straight line. "Successively" is merely intended to express the fact that the base surfaces, rather than the lateral surfaces, of two neighboring cylindrical workpieces face one another.

The workpieces are preferably not fixed directly on the mounting plate, but are instead first fastened on a so-called sawing bar or sawing base. The workpiece is generally fastened on the sawing bar by adhesive bonding. Preferably, each workpiece is adhesively bonded individually onto its own sawing bar. The sawing bars with the workpieces fastened on them are subsequently fastened on the mounting plate, for example by adhesive bonding or screwing.

Steps c), d):

Subsequently, the mounting plate with the workpieces fixed on it is clamped in the multi wire saw in step c) and the workpieces are sliced simultaneously and essentially perpendicularly to their longitudinal axis into wafers in step d). The gang length of the multi wire saw is optimally utilized in this case owing to the selection of the workpieces made in step a), which increases the throughput and therefore the economic viability.

In a preferred embodiment of the first method according to the invention, the delivery deadlines arranged with various customers are taken into account when selecting the workpieces in step a). Workpieces that can be used for the production of wafers, for which an earlier delivery deadline is arranged, are preferably selected in step a).

It is also conceivable to provide that Inequality (1) in step a) no longer categorically needs to be satisfied when the time until a delivery deadline is less than a predefined minimum time. In this case, complying with the delivery deadline takes priority over optimal utilization of the gang length.

Another preferred option consists in always first selecting a workpiece which is required in order to fulfill the still unprocessed order with the earliest delivery deadline. Further workpieces are subsequently selected so that the gang length is used in the best possible way.

As described above, the stock of workpieces is produced for example by slicing crystals perpendicularly to their longitudinal axis into at least two workpieces with a length $L_i$, which are added to the stock. The length of the workpieces should not exceed the gang length $L_G$ of the multi wire saw used in step d). In another preferred embodiment of the first method according to the invention, the specifications established in the individual orders for the warp of the wafers is already taken into account when producing the stock of workpieces from a stock of cylindrical crystals. The parameter "warp" is defined in the SEMI standard M1-1105. In general a maximum value for the warp of the wafer, which should not be exceeded, is specified for each order from the customer. This maximum value differs from customer to customer and from order to order. There are therefore always orders with a warp specification which is easy to satisfy, and orders with a demanding warp specification. In order to fulfill in particular the latter orders while complying with specification, according to the preferred embodiment, a crystal which is assigned to an order with a low maximum value for the warp is sliced into workpieces which are as long as possible. The length $L_i$ of the workpieces in relation to the gang length $L_G$ of the multi wire saw used in step d) preferably satisfies the relation $L_G/2 < L_i \leqq L_G$ in this case.

With reference to the example of silicon wafers with a diameter of 300 mm, FIG. 1 represents the way in which the average value and the distribution of the warp depend on the length of the sliced crystal pieces. The left-hand part of the figure represents the statistical evaluation of a batch 1 of 13,297 wafers, which were produced from crystal pieces with a length of 250 mm or less. The average warp is 25.5 μm, and the standard deviation is 7.2 μm. The right-hand part of the figure depicts the statistics for a batch 2 of 33,128 wafers, which were produced from crystal pieces with a length of 345 mm or more. In this case the average value of the warp is only 23.3 μm, with a standard deviation of 7.3 μm. Wafers produced from longer workpieces are distinguished on average by a smaller warp, without dummy pieces having to be adhesively bonded onto the end surfaces of the workpiece. For this reason, particularly in the case of orders with a demanding warp specification it is expedient to ensure a maximally large length of the workpieces when producing the workpieces by slicing the crystals.

If this rule were to be applied for all orders, the effect would be that too many workpieces with a large length are added to the stock and, for the selection in step a), too few workpieces are available which can be fastened together with the long workpieces in step b) on a common mounting plate and sliced in one working step into wafers in step d). Although such a measure would improve the warp achieved on average, at the same time the capacity of the multi wire saw would no longer be utilized optimally. According to this embodiment, therefore, crystals which are assigned to an order with a high maximum value for the warp (which is relatively easy to achieve) are sliced into comparatively short workpieces. The length $L_i$ of these workpieces in relation to the gang length $L_G$ of the multi wire saw used in step d) preferably satisfies the relation $L_i<L_G/2$. For orders with a warp specification which is not very demanding, it is unnecessary to produce workpieces which are as long as possible. At the same time, this measure ensures that a sufficient number of short pieces are always available, which can be combined in step a) with the long workpieces for the orders with a demanding warp specification, and can be processed together with them in the further steps in order to utilize the gang length of the multi wire saw optimally.

This embodiment thus makes it possible to produce a multiplicity of wafers which have a narrow distribution of the geometrical parameter "warp" at a comparatively low level, for orders with a demanding warp specification. At the same time, an improvement of the warp is deliberately obviated for the other orders in order to optimally utilize the gang length of the multi wire saw.

The second embodiment according to the invention will be described in detail below with the aid of FIGS. 2-12, the figures merely representing a preferred embodiment of the method.

In contrast to the method described in U.S. Pat. No. 6,119,673, the invention safeguards against confusion by means of separating pieces 15 fixable firmly on the wafer carrier 13, which in step f) are preferably inserted preferably laterally between the wafer stacks 121, 122, 123 and then fixed on the wafer carrier 13. The wafer stacks 121, 122, 123 stabilized in this way are optionally subjected to cleaning. The bond between the wafers 12 and the mounting plate 11 is subsequently released, while the separating pieces 15 support the wafer stacks 121, 122, 123 against lateral tilting.

This method avoids mixing or confusion of wafers 12 which have been produced from different workpieces and are intended for different orders. Furthermore, the stacks 121, 122, 123 of wafers 12 are protected reliably in steps g) and i) against lateral tilting and therefore damage to the sensitive wafer edge.

Steps a)-d):

In step a), at least two workpieces are selected from a stock of workpieces. The selection is preferably carried out as described for step a) of the first method according to the invention. In this case, the spacing $A_{min}$ in step a) is selected so that it corresponds at least to the thickness of the separating pieces 15, optionally plus the thickness of the separating plates 17 (if such separating plates are used), so that they can be introduced into the space. Steps b) to d) are also preferably carried out as in the first method according to the invention.

Figure 2:
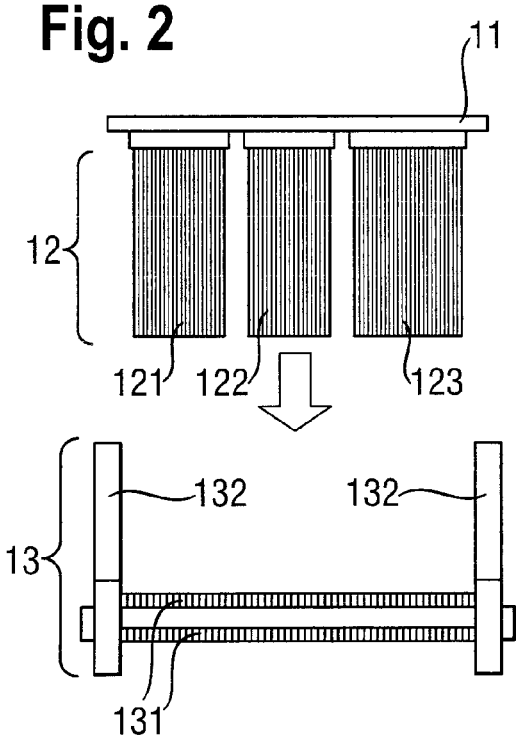
FIG. 2 shows a mounting plate with a plurality of stacks of wafers, which is introduced from above into a wafer carrier in step e) of a second embodiment according to the invention (in lateral view with respect to the wafers).
Figure 3:
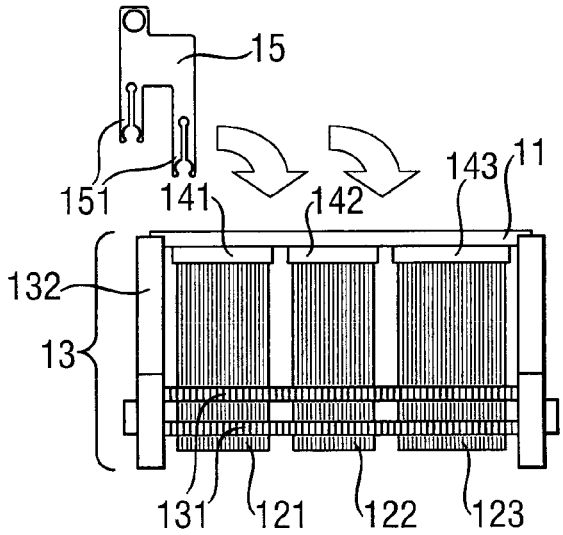
FIG. 3 shows the mounting plate with a plurality of wafer stacks introduced into the wafer carrier and the application of the separating pieces in step f) of a second embodiment according to the invention.

Step e):

In step e), the wafers 12 fixed on the mounting plate 11 are put into a wafer carrier 13 which supports each wafer on at least two points of the wafer circumference that lie away from the mounting plate (FIG. 2). The wafer carrier 13 is designed for example as an arrangement of a plurality of cylindrical rods 131 (an arrangement of four rods is represented in FIG. 2, only two of which can be seen), which support the wafers 12 from below on their circumference. The rods 131 are held together at their ends by two plate-shaped end pieces 132. The wafer carrier 13 may, for example, be designed so that the mounting plate 11 can be placed onto the upper ends of the end pieces 132. The rods 131 preferably comprise V-grooves according to DE10210021A1 extending around the lateral surface at particular spacings. FIG. 3 shows the state after having put in the mounting plate 11 with the sliced wafers 12, which exist in stacks 121, 122 and 123. In the embodiment represented, the wafers 12 are connected not directly to the mounting plate 11 but to sawing bars 141, 142, 143 corresponding to the wafer stacks 121, 122, 123.

Step f):

In step f) (FIG. 3), a separating piece 15 is introduced into each of the spaces respectively between two wafer stacks 121, 122, 123. The separating pieces (FIG. 12) are designed so that they can be fastened on the wafer carrier 13 in such a way that the wafer stacks 121, 122, 123 are laterally supported. For example, the separating pieces 15 are designed so that when using the wafer carrier 13 as illustrated, they can be connected at one end to the rods 131 of the wafer carrier 13 by at least one connecting device 151. The connecting device 151 may for example, as illustrated in the figures, be configured as a pincer-like resilient clip-on connection which can be clipped onto the rods 131. Entirely different connecting devices may nevertheless be envisaged, for example fastening by means of screwable clamps. In any event, the shape of the separating piece 15 should be adapted to the shape of the wafer carrier 13, the shape of the separating piece not being subjected to any particular restrictions. Preferably, however, the separating piece 15 has a comparatively large extent in the vertical direction ("vertical" refers to the state in which the separating piece 15 is connected to the wafer carrier 13), in order to be able to effectively support the wafer stacks 121, 122, 123 laterally. The separating pieces are preferably made of a material which is geometrically stable and can withstand the temperatures prevailing (for example in step g)) and the chemicals coming in contact with it (for example in step g)).

Figure 4:
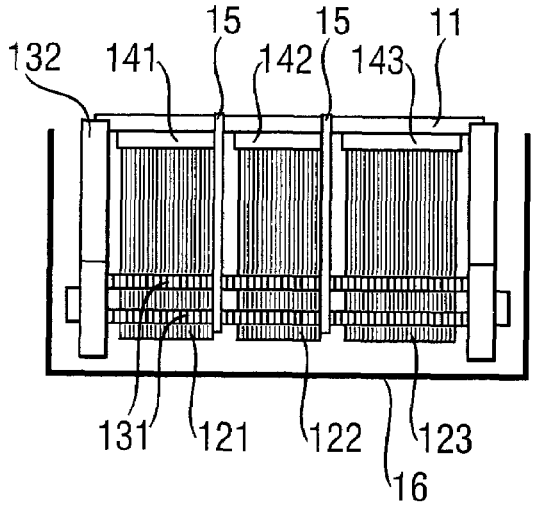
FIG. 4 shows the arrangement of FIG. 3, which is immersed into a basin filled with a liquid in order to release the bond between the wafers and the mounting plate in step g) of a second embodiment according to the invention.
Figure 5:
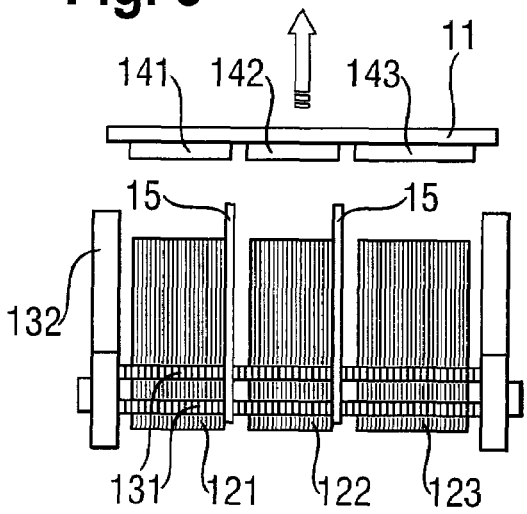
FIG. 5 shows the removal of the mounting plate from the wafer stacks, which are supported by the wafer carrier.

Step g):

In step g), the bond between the wafers 12 and the mounting plate 11 is released. In the preferred embodiment represented in the figures, the wafer carrier 13 with the wafers 12 fixed on the mounting plate 11 via the sawing bars 141, 142, 143 is put into a basin 16 filled with a liquid, as represented in FIG. 4. The liquid dissolves the adhesive bond between the wafers 12 and the sawing bars 141, 142, 143. In the case of a water-soluble adhesive the liquid is water, preferably hot water. The mounting plate 11 with the sawing bars 141, 142, 143 is subsequently removed (FIG. 5) and the wafer carrier 13 is taken out of the basin 16. The wafers 12 existing in stacks 121, 122, 123 are now supported from below by the rods 131 and secured laterally by the separating pieces 15. This prevents lateral tilting of the wafers 12 and fracture of the wafer edges. At the same time, the separating pieces 15 demarcate the boundaries between the wafer stacks 121, 122, 123 which come from different workpieces. Mixing or confusion of wafers coming from different workpieces is therefore avoided in the further course of the method.

Figure 6:
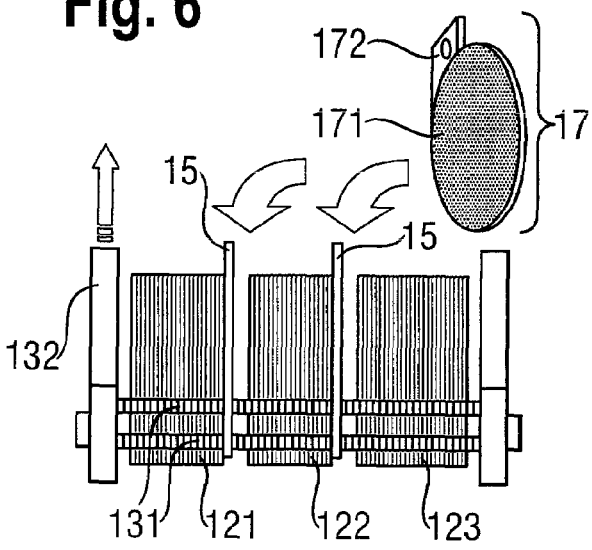
FIG. 6 shows the introduction of the separating plates.
Figure 11:
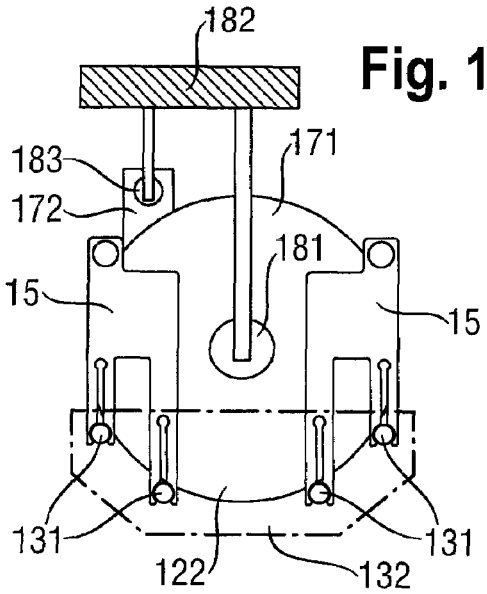
FIG. 11 shows the removal of a separating plate from the wafer carrier, corresponding to FIG. 7 but in frontal view with respect to the wafers.
Figure 12:
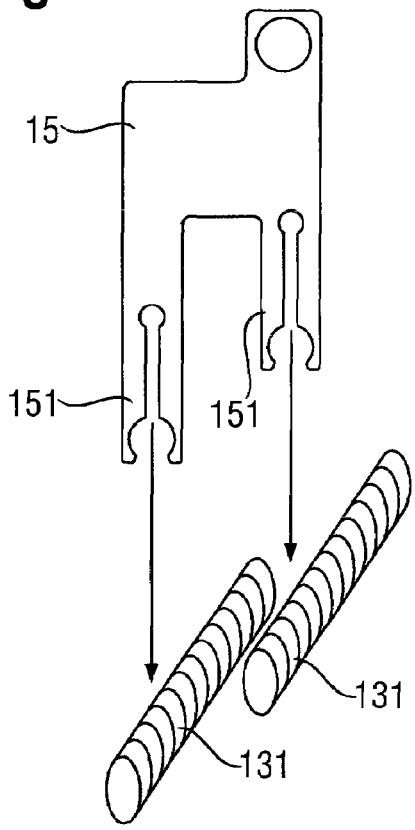
FIG. 12 shows an embodiment of a separating piece according to the invention with two rods of a wafer carrier, onto which the separating piece is fitted.

Optional Step h):

Between the steps g) and i), an additional step h) is preferably carried out in which at least one separating plate 17 is introduced into each of the spaces between two neighboring stacks 121, 122, 123 of wafers 12, in addition to the separating piece 15 fastened there (FIG. 6). The separating plates 17 are different from the wafers 12. The separating plates stand freely on the rods 131 of the wafer carrier 13 and are not fastened to it. The separating plates 17 are preferably configured so that they can be automatically distinguished from the wafers 12 by a sensor 183 (FIG. 11). Besides a circularly round part 171, the embodiment of the separating plates 17 as represented in FIG. 6 comprises a part 172 which protrudes beyond the circular surface and can be recognized by a sensor 183. It is nevertheless also conceivable to recognize the separating plate by its material properties.

The separating plates 17 are preferably made of a material which is geometrically stable and can withstand the prevailing temperatures and the chemicals coming in contact with it.

Figure 7:
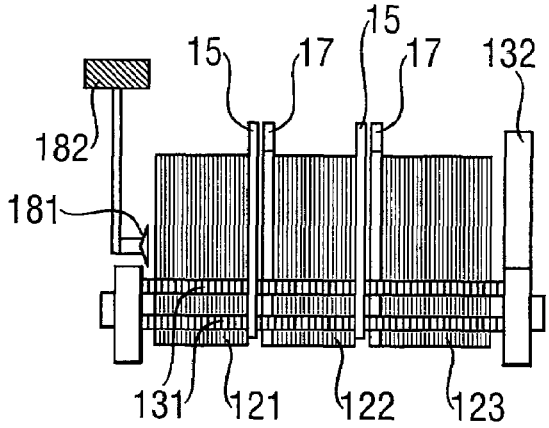
FIG. 7 shows the individual removal of the wafers from the wafer carrier in step i) of the second method according to the invention.
Figure 8:
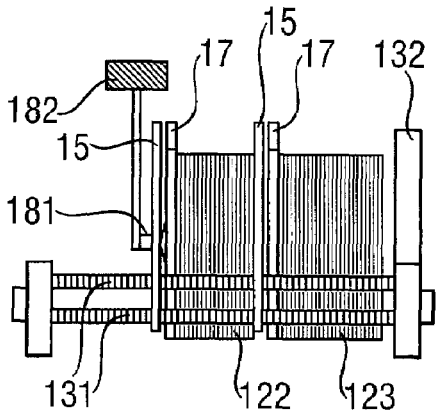
FIGS. 8 and 9 show the removal of a separating plate from the wafer carrier.
Figure 9:
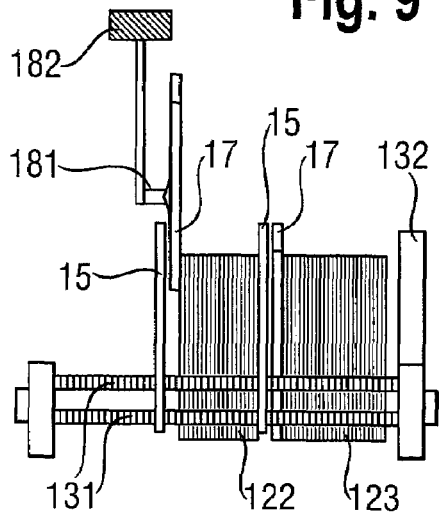
Figure 10:
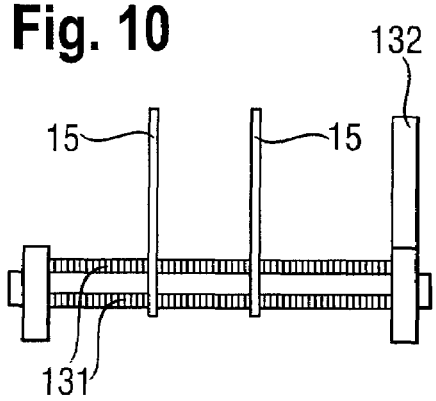
FIG. 10 shows the empty wafer carrier with separating pieces fastened on it.

Step i):

In step i), the wafers are removed individually from the wafer carrier 13, for example by means of a vacuum suction device 181. In order to obtain the lateral access to the wafers 12 required for their removal, at least one of the end pieces 132 of the wafer carrier 13 may comprise a suitable opening (for example a vertical slot) through which the vacuum suction device can be moved laterally onto the wafers 12. Alternatively, at least one of the end pieces 132 may be designed in two parts, in which case the upper part can be taken off. This is represented in FIGS. 6, 7 and 10. The individual removal of the wafers 12 (FIG. 7) may be carried out either manually or preferably by a robot 182, as indicated in FIG. 7. After having been removed from the wafer carrier 13, the wafers 12 are either sent directly for further processing, for example cleaning, or first put into a cassette. During their removal, the boundaries between the wafer stacks 121, 122, 123 can be easily recognized with the aid of the separating pieces 15 (or with the aid of the separating plates 17 which may have been fitted in the optional step h)) and preserved by separate further processing or storage of the wafers 12 coming from different workpieces.

In the case of automatic individual removal by a robot 182 (FIGS. 7, 8, 9, 11), the separating plates 17 represented in the figures can easily be recognized by a sensor 183 with the aid of their parts 172 protruding beyond the circular surface 171 (FIG. 11). The separating plates 17 are preferably likewise removed by the robot 182 by means of the vacuum suction device 181 and stored separately from the wafers 12. The wafers 12 of the next stack 122, 123 (FIGS. 8, 9) are removed similarly as the wafers of the first stack 121 and, for example, respectively put into other cassettes. FIG. 10 shows the fully emptied wafer carrier 13 with separating pieces 15 fastened on the rods 131.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for simultaneously slicing at least two cylindrical workpieces into a multiplicity of wafers by means of a multi wire saw with a gang length $L_G$, comprising the following steps:

a) selecting a number $n \geqq 2$ of workpieces from a stock of workpieces with different lengths, so that the inequality $$L_G \geq (n-1)\cdot A_{\min} + \sum_{i+1}^{n} L_i \tag{1}$$

is satisfied and at the same time the right-hand side of the inequality is as large as possible, where $L_i$ with i=1 . . . n stands for the lengths of the selected workpieces and $A_{min}$ stands for a predefined minimum spacing, b) fixing the n workpieces successively in the longitudinal direction on a mounting plate while respectively maintaining a spacing $A \geqq A_{min}$ between the workpieces, which is selected so that the relation $$L_G \geq (n-1)\cdot A + \sum_{i=1}^{n} L_i \tag{2}$$

is satisfied, c) clamping the mounting plate with the workpieces fixed thereon in the multi wire saw, and d) slicing the n workpieces perpendicularly to their longitudinal axis by means of the multi wire saw.

2. The method of claim 1, wherein step a) is carried out so that the inequality $$L_G \geq (n-1)\cdot A + \sum_{i=1}^{n} L_i \geq L_{\min} \tag{3}$$

is satisfied, where $L_{min}$ stands for a predefined minimum length which is less than the gang length $L_G$.

3. The method of claim 2, wherein $L_{min} \geqq 0.7 \cdot L_G$.

4. The method of claim 1, wherein workpieces that can be used for the production of wafers which have an earlier delivery deadline are preferably selected in step a).

5. The method of claim 4, wherein Inequality (1) in step a) is not satisfied for a single or plurality of workpiece sawings when the time until a delivery deadline is less than a predefined minimum time, but is satisfied for the remainder of workpiece sawings.

6. The method of claim 4, wherein a workpiece which is required in order to fulfill a still unprocessed order with the earliest delivery deadline is selected as the first workpiece in each case, and further workpieces are subsequently selected so that the right-hand side of Inequality (1) is as large as possible.

7. The method of claim 1, wherein the selection of the workpieces in step a) is carried out by a computer which has access to the lengths of all workpieces in the stock.

8. The method of claim 1, wherein the stock of workpieces is produced from a stock of cylindrical crystals by slicing each crystal perpendicularly to its longitudinal axis into at least two workpieces with a length $L_i$, which is not more than the gang length $L_G$ of the multi wire saw used in step d), wherein each crystal is assigned to one or more orders, wherein a maximum value which must not be exceeded is specified for the warp of a wafer for each order, and wherein 1) a crystal which is assigned to an order with a low maximum value for the warp is sliced into workpieces which are as long as possible, and 2) a crystal which is assigned to an order with a high maximum value for the warp is sliced into comparatively short workpieces.

9. The method of claim 8, wherein the relation $L_G/2<L_i \leqq L_G$ applies for the length $L_i$ of the workpieces in case 1).

10. The method of claim 8, wherein the relation $L_i<L_G/2$ applies for the length $L_i$ of the workpieces in case 2).

11. The method of claim 9, wherein the relation $L_i<L_G/2$ applies for the length $L_i$ of the workpieces in case 2).

12. A method for simultaneously slicing at least two cylindrical workpieces into a multiplicity of wafers by means of a multi wire saw with a gang length $L_G$, comprising the following steps:

a) selecting a number $n \geqq 2$ of workpieces from a stock of workpieces with different lengths, so that the inequality $$L_G \geq (n-1)\cdot A_{min} + \sum_{i+1}^{n} L_i L_G \geq (n-1)\cdot A_{min} + \sum_{i+1}^{n} L_i \quad (1)$$

is satisfied and at the same time the right-hand side of the inequality is as large as possible, where $L_i$ with i=1 . . . n stands for the lengths of the selected workpieces and $A_{min}$ stands for a predefined minimum spacing, b) fixing the n workpieces successively in the longitudinal direction on a mounting plate while respectively maintaining a spacing between the workpieces, c) clamping the mounting plate with the workpieces fixed thereon in the multi wire saw, d) slicing the n workpieces perpendicularly to their longitudinal axis by means of the multi wire saw so as to form n stacks of wafers fixed on the mounting plate, e) putting the wafers fixed on the mounting plate into a wafer carrier, which supports each wafer on at least two points of the wafer circumference that lie away from the mounting plate, f) introducing at least one separating piece into each of the spaces between two neighboring stacks of wafers and fastening the separating piece on the wafer carrier, g) releasing the bond between the wafers and the mounting plate, i) sequentially removing each individual wafer from the wafer carrier.

13. The method of claim 11, wherein the boundaries between the stacks of wafers are identified with the aid of the position of the separating pieces in step i), and the wafers of a stack are further processed separately from the wafers of the other stacks.

14. The method of claim 12, wherein between the steps g) and i), an additional step h) is carried out in which at least one separating plate is introduced into each of the spaces between two neighboring stacks of wafers in addition to the separating piece fastened there, wherein the separating plate is different from the wafers and is not fastened on the wafer carrier.

15. The method of claim 14, wherein the boundary between the stacks of wafers is identified with the aid of the position of the separating plate in step i), and the wafers of a stack are further processed separately from the wafers of the other stacks.

* * * * *

UNITED STATES PATENT AND TRADEMARK OFFICE

CERTIFICATE OF CORRECTION

PATENT NO. : 7,766,724 B2
APPLICATION NO. : 11/923722
DATED : August 3, 2010
INVENTOR(S) : Anton Huber et al.

It is certified that error appears in the above-identified patent and that said Letters Patent is hereby corrected as shown below:

Column 11, Line 30, Claim 12:

Delete:

$$L_G \geq (n-1) \cdot A_{min} + \sum_{i+1}^{n} L_i L_G \geq (n-1) \cdot A_{min} + \sum_{i+1}^{n} L_i \qquad (1)$$

" "

and insert $$L_G \geq (n-1) \cdot A_{min} + \sum_{i+1}^{n} L_i$$

-- --

Signed and Sealed this

Nineteenth Day of October, 2010

David J. Kappos

David J. Kappos
*Director of the United States Patent and Trademark Office*